United States Patent [19]

Hicks

[11] 3,999,688

[45] Dec. 28, 1976

[54] SHROUDED TUBE SQUEEZER

[76] Inventor: Alan Wood Hicks, 321 W. North Ave., Space 31, Lompoc, Calif. 93436

[22] Filed: Apr. 9, 1976

[21] Appl. No.: 675,517

[52] U.S. Cl. ..... 222/102

[51] Int. Cl.[2] ..... B65D 35/28

[58] Field of Search ..... 222/102, 101

[56] References Cited

UNITED STATES PATENTS

| | | | |
|---|---|---|---|
| 1,510,818 | 10/1924 | Barron | 222/102 |

FOREIGN PATENTS OR APPLICATIONS

| | | | |
|---|---|---|---|
| 136,133 | 6/1952 | Sweden | 222/102 |
| 1,364,435 | 8/1974 | United Kingdom | 222/102 |
| 282,485 | 12/1927 | United Kingdom | 222/102 |

*Primary Examiner*—Stanley H. Tollberg
*Attorney, Agent, or Firm*—Harry W. Brelsford

[57] ABSTRACT

A pair of parallel cylindrical rollers have contrarotation maintained by a pair of gears. The cylinders and gears are enclosed by a housing that acts as a safety shroud, and one of the cylinders is rotated manually by a drive member external to the shroud. The safety shroud has an entrance slit and an exit slit for passing a tube between the rollers, and the dimensions of the slits transverse to the roller axes are carefully selected to prevent entry and damage to the fingers of children and adults. The shroud housing provides bearings for the rollers and for a spring mounting of one of the rollers to admit tubes of varying thickness and to grip tubes securely regardless of irregularities in the tube being squeezed.

1 Claim, 5 Drawing Figures

SHROUDED TUBE SQUEEZER

This invention relates to manual roller squeezers for extruding the contents of a deformable tube such as toothpaste tubes, shaving cream tubes, hand lotion tubes, and similar tubes.

Various types of squeezers for toothpaste tubes have been used for decades. Some employ but one roller to squeeze the tube against an adjacent flat surface. Others employ two rollers in various configurations. I have found that these prior art devices are inconvenient to use, some are inefficient, and the most effective are dangerous to use, especially by children. When children try to use prior art squeezers, their fingers get in the squeeze area of the device and are severely pinched, even the skin being broken at times.

In summary, I have discovered that an efficient squeezer can be rendered safe to use by children and others by enclosing the mechanism in a safety housing or shroud. I have further discovered that there is a maximum height of entrance and exit slit that can be used to provide safety for the fingers of children. This I have determined to be approximately three-sixteenths of an inch. The exit slit should have this same safety dimension, because the device can be rotated backward so that the entrance slit now becomes the exit slit. There is no "correct" way to use either slit on the device as an entrance slit, and both slits may be entranced and exit slits, thus accommodating righthanded and lefthanded persons. This same slit width in my geometrical configuration also allows for effective squeezing of the tube.

Mechanically, I employ a pair of parallel rollers that are normally held in contact with each other by a spring which allows them to separate to admit a flattened tube between them. Contrarotation of the rollers is achieved by separate gearing with teeth long enough to accommodate roller separation under the spring action. The roller surfaces are roughened to grip any tube inserted between them. The rollers are journaled in bearings provided by the safety housing. An external key or knob is provided for manually rotating one roller, and the gear engagement causes both rollers to rotate in unison in a contrarotating direction.

Various objects, advantages, and features of the invention will be apparent in the following description and claims considered together with the accompanying drawings forming an integral part of this specification and in which:

Figure 1:
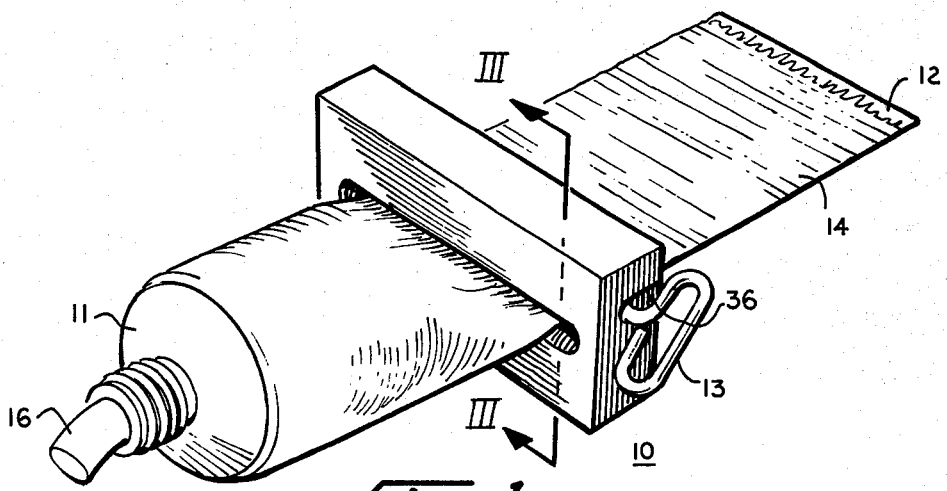
FIG. 1 is a three-dimensional view of my tube squeezer applied to a tube, causing it to move the contents to the left, so that the user can extrude the contents by manually squeezing the tube.

Referring to FIG. 1, there is illustrated a squeezer 10 embodying the invention as applied to a squeeze tube 11. The bottom edge 12 of the squeeze tube has been inserted into the squeezer 10, and a manual key 13 has been manually rotated to flatten a section 14 of the tube 11 to cause its contents to extrude in a stream 16.

Figure 3:
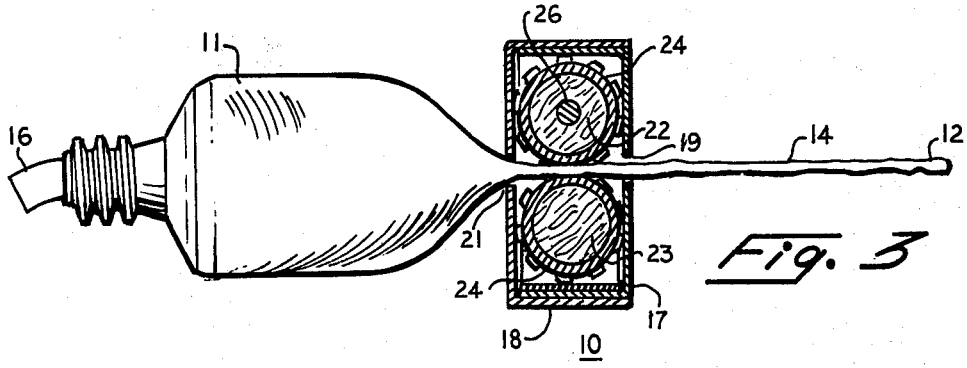
FIG. 3 is a sectional view along the line III—III of FIG. 1.

Referring now to FIG. 3, it will be noted that the outer housing for the squeezer 10 is formed of two open boxes that telescope together, an inner telescoping box 17 and an outer telescoping box 18. The inner box has an exit slit 19 formed therein, and the outer box has an entrance slit 21 formed therein. The tube 11 is flattened by a pair of cylindrical rollers 22 and 23, having an outer shell 24 of a granular nature such as that producing a sand finish or such as that produced by a layer of sandpaper or emery cloth.

Figure 2:
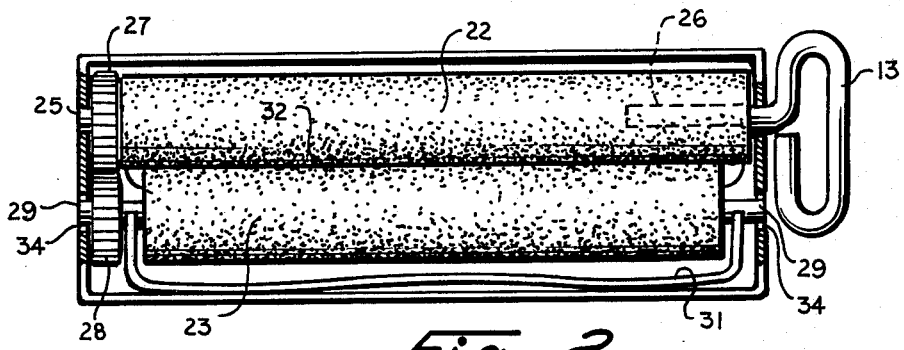
FIG. 2 is an elevation view on an enlarged scale of the device of FIG. 1 with the outer cover removed and with portions broken away to show bearing structure.

Referring now to FIG. 2, the winding key 13 has a stem 26 embedded in the upper roller 22, which drives that roller in rotation. Secured about the axis of the upper cylinder 22 is a spur gear 27, which engages a corresponding spur gear 28 axially secured to the lower roller 23. Rotation of the upper roller 22 by the key 13 therefore causes the lower roller 23 to rotate in a contrarotating direction with the upper roller causing the tip end 12 and the flattened part 14 of the tube 11 to be moved to the right as viewed in FIG. 1 when the key 13 is rotated in a counterclockwise direction. The lower roller 23 is provided with an axle 29 on each end, and bearing against these two axles 29 is a U-shaped spring 31, which urges the lower roller 23 against the upper roller 22, so that they have a line of contact 32, as shown in FIG. 2.

Figure 5:
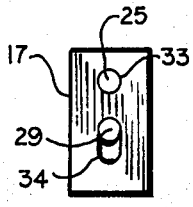
FIG. 5 is an end view on a reduced scale of the lefthand end of FIG. 2, showing the bearing structures for the rollers.

The inner telescoping member 17 (FIG. 3) not only acts as a shroud for the rollers 22 and 23 and the gears 27 and 28, but it also acts as a structural housing to support the rollers. This bearing support is shown in FIGS. 2 and 5, wherein it will be noted that the upper roller 22 has an axle 25 which fits within a round hole 33, which acts as a bearing. Formed in the end plates of the inner telescoping box 17 is a lower oval hole 34 in which rides the axles 29 of the lower roller 23. As the lower roller 23 moves away from the upper roller 22 when a flattened tube section 14 is disposed between them, the axles 29 move downwardly in the oval slots 34 under the yielding of the U-shaped spring 31. In a similar fashion the righthand end of the upper roller 22, as viewed in FIG. 2, has its axle 26 journaled within similar a aperture 33. The oval holes 34 limit the separation of the rollers to make sure that the teeth of gears 27 and 28 remain in engagement and also to ensure a tight frictional grip on a tube being squeezed.

Figure 4:
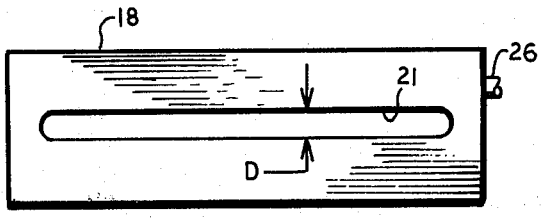
FIG. 4 is an elevation view on a reduced scale of the device of FIG. 1, but with the operating key removed.

Referring now to FIG. 4, there is illustrated the entrance slot 21, which may be as wide as any expected width of a flattened tube 11. The transverse dimension D, however, is critical from a safety standpoint, and I have discovered that if this dimension is approximately three-sixteenths of an inch children will be unable to get their fingers through the slit and, therefore, cannot be injured if the rollers 22 and 23 are rotated. This transverse dimension D is also sufficient to accommodate the tube 11, even when full, as the bottom edge 12 will be gripped by the rollers 22 and 23 and will pull the tube through the device. Generally, however, the user manually flattens the tube somewhat before it enters the entrance slit 21. This dimension D can vary by an increase of up to thirty per cent and a decrease of about fifteen per cent without interfering with either the safety or the operation of the device.

I prefer to hold the tube telescoping boxes 17 and 18 together in a positive manner, as by gluing if the housings are made of plastic, welding if made of steel, or by employing fasteners. In this connection the outer box 18 has a horizontal slit 36 in the righthand end panel as viewed in FIG. 1 to accommodate the shank 26 of the winding key 13.

In operation, a user normally flattens the tube with his fingers to extrude toothpaste, etc. My device may be used to make sure that all the contents are squeezed out of the tube as this is difficult to do by manually squeezing. Usually, the tube cap will be in place when my device is used. However, my device can be used on a new, full tube to extrude the contents if the user so desires. The user inserts the tube end 12 between the rollers 22 and 23 and then rotates the key 13 manually. The rough surface 24 of the rollers grasps the tube and moves it to the right, as viewed in FIG. 1. The rollers 22 and 23 separate against the compression of strap spring 31, but the amount of separation is limited by the movement of the lower roller in its oval bearing 34. The teeth of gears 27 and 28 engage at all times so that there is a positive drive on both rollers. Either aperture 19 or 21 may be used as an entrance slit, depending upon the direction of rotation of key 13.

Any desired materials of construction may be employed. I presently prefer that the rollers be made of wooden dowels covered with a layer of Carborundum paper that is fairly coarse. I presently prefer sheet metal to form the two open boxes 17 and 18 that telescope together, but it is obvious that in large-scale production would probably be preferable. The gears 27 and 28 may be made of any desired materials, such as pot metal or plastic. The spring 31 is preferably made of steel. It will be obvious that a knob could be substituted for the key 13 to rotate the rollers 22 and 23. I presently prefer to assemble the device by inserting the upper roller 22 with the key 13 absent. The lower roller 23 and spring 31 are inserted as a unit, and the spring allows insertion of one axle 29 into one hole 34, and it protrudes enough to allow the other axle 29 to be inserted. The spring 31 then centers the axles 29 into the holes 34. Thereafter, the shank 26 of the key 13 is inserted through the appropriate hole 33, and the assembly is complete. After the two shells 17 and 18 are telescoped together, they may be fastened together in any suitable fashion.

It will be apparent to those skilled in the art that various modifications may be made herein, and there are included within the terms of the following claims all such variations and modifications that fall within the true spirit and scope of the invention.

I claim:

1. A shrouded tube squeezer comprising:

a. a pair of parallel cylindrical rollers disposed side by side to define a line of contact;

b. a spring yieldingly holding the rollers into rolling engagement;

c. a spur gear connected to adjacent ends of each roller and each having an outside diameter greater than the roller diameter and meshing with each other to cause contrarotation of the rollers;

d. an inner box open on one face having a pair of bearings at each end for journaling the cylindrical rollers and having a tube slit opposite the open face parallel to the line of contact and acting as a shroud for one side of the roller;

e. an outer open box open on one face telescoping over the inner box to close the open faces of each box and said outer box covering the bearings on the inner box and having a tube slit parallel to the line of contact and acting as a shroud;

f. and a manual drive member external to the boxes and engaging one of the rollers to manually rotate both rollers through the gears to flatten a tube inserted into one of the slits and thereby squeeze out any contents of the tube and permit the squeezed tube to exit from the other slit.

* * * * *